United States Patent [19]

King

[11] Patent Number: 4,962,549

[45] Date of Patent: Oct. 16, 1990

[54] IN-TANK DISPENSING DEVICE FOR DOSING A TOILET BOWL

[75] Inventor: Stephen King, Sylvania Heights, Australia

[73] Assignee: R & C Products Pty. Limited, Ermington, Australia

[21] Appl. No.: 347,988

[22] Filed: May 5, 1989

[30] Foreign Application Priority Data

May 5, 1988 [AU] Australia ..... 15611/88

[51] Int. Cl.[5] ..... E03D 9/03

[52] U.S. Cl. ..... 4/228; 4/227

[58] Field of Search ..... 4/227, 228, 230, 231, 4/232, 223, 224

[56] References Cited

U.S. PATENT DOCUMENTS

| | | | |
|---|---|---|---|
| 1,419,498 | 6/1922 | Grant | 4/232 |
| 4,171,546 | 10/1979 | Dirksing | 4/227 |
| 4,432,102 | 2/1984 | Woodruff et al. | 4/228 |
| 4,480,341 | 11/1984 | Richards | 4/228 |
| 4,507,811 | 4/1985 | Buelow et al. | 4/228 |
| 4,507,812 | 4/1985 | Dubois et al. | 4/228 |
| 4,513,459 | 4/1985 | Doughty | 4/222 |
| 4,530,118 | 7/1985 | Richards | 4/228 |
| 4,555,819 | 12/1985 | Weiss et al. | 4/223 |
| 4,707,866 | 11/1987 | Von Phillip | 4/228 |
| 4,709,424 | 12/1987 | Dolan | 4/228 |
| 4,777,670 | 10/1988 | Klinkhummer et al. | 4/223 |

FOREIGN PATENT DOCUMENTS

| | | | |
|---|---|---|---|
| 4279585 | 11/1986 | Australia . | |
| 2916247 | 10/1980 | Fed. Rep. of Germany | 4/228 |
| 2554145 | 3/1985 | France . | |
| 21166 | of 1909 | United Kingdom . | |
| 379553 | 6/1932 | United Kingdom . | |
| 2114623 | 8/1983 | United Kingdom . | |
| 2115850 | 9/1983 | United Kingdom . | |

*Primary Examiner*—Henry J. Recla
*Assistant Examiner*—Edward C. Donovan
*Attorney, Agent, or Firm*—Frederick H. Rabin

[57] ABSTRACT

A passive dispenser, adapted to be positioned in the cistern of a toilet, useful for dosing a toilet bowl with an additive such as a disinfectant, cleaning agent, colorant, perfume or the like, has a first chamber and a second chamber separated by a common wall having an opening therein, a second wall extending upwardly from a base of a second of the chambers and spaced apart from the common wall opening to define a cavity having an open upper end to permit fluid communication between the chambers, the first chamber being adapted to hold the additive, the second chamber having a filling means to admit water thereinto during filling of the cistern and a discharge means to discharge additive-containing water into the toilet bowl when the toilet is flushed.

10 Claims, 3 Drawing Sheets

IN-TANK DISPENSING DEVICE FOR DOSING A TOILET BOWL

FIELD OF THE INVENTION

This invention relates to devices adapted to dispense a water soluble or dispersible additive into a flushable toilet cistern and bowl thereof. More particularly, the present invention relates to such a device having no moving part that is able to minimize the amount of additive that is flushed to waste and is present in the cistern water during quiescent periods, whilst maximizing the amount of additive present in the water of a toilet bowl after flushing.

BACKGROUND TO THE INVENTION

The prior art is replete with devices for use in dispensing an additive into a toilet cistern and a bowl thereof, which require no moving parts to facilitate their action. These range from relatively simple devices, such as those in which a block of additive material is held within a container having an opening into which the water in the cistern enters and dissolves or disperses the additive and by diffusion through the opening produces a concentration of additive in the cistern water, to relatively complex devices having air locks, baffles and the like to facilitate controlled delivery of additives.

An example of the latter mentioned type is disclosed in UK patent application No. GB2114623-A. Although dispensers of the latter type have the ability to provide a substantially constant concentration and volume of additive to the cistern and bowl, their complex design and resultant relative high costs generally have made these devices unattractive in large scale consumer use.

Similarly, whilst the relatively simple dispensers of the first mentioned kind have achieved wide consumer acceptance, because the additive is present in the cistern water, when a toilet is flushed, a substantial proportion of the additive will be flushed to waste. As the additive is generally required to produce an effect in the water of the toilet bowl, the amount of additive not remaining in the bowl after flushing is clearly wasted. Moreover, in most cases, the presence of additive in the cistern water during quiescent periods serves no useful purpose. Further, by allowing the relatively large volume of cistern water to remain in continuous contact with the additive during quiescent periods, this results generally in increasing concentration of additive in the cistern water with time.

To minimize the amount of additive wasted, additives have been incorporated into various solid matrices that allow the additive to be dissolved or dispersed in the cistern water at a controlled rate. Whilst this approach may achieve some reduction in the maximum concentration of additive in the cistern water, nevertheless, during prolonged quiescent periods, the concentration of additive in the cistern water will become excessive. More importantly, this approach will have no effect on the proportion of additive that is flushed to waste.

SUMMARY OF THE INVENTION

The present inventor has recognized these difficulties inherent in the prior art and in the present invention seeks to provide a dispenser that is relatively simple in design but which is able to minimize the proportion of additive that is flushed to waste, so that the major proportion of additive that is dispensed remains in the toilet bowl water after flushing.

Accordingly, the present invention consists in a passive dispenser for use in dosing a toilet bowl with an additive comprising a first chamber and a second chamber separated by a common wall having an opening therein, a second wall extending upwardly from a base of a second of the chambers and spaced apart from the common wall opening to define a cavity having an open upper end to permit fluid communication between the chambers, the first chamber being adapted to hold the additive, the second chamber having a filling means to admit water thereinto during filling of the cistern and a discharge means to discharge additive-containing water into the toilet bowl when a toilet is flushed.

DETAILED DESCRIPTION OF THE INVENTION

In order to allow water in the cistern to enter the dispenser, it is immersed in the cistern to an extent sufficient to ensure that when the cistern is full, water will enter the first chamber through the passage. This may be achieved by suspending the dispenser from an upper portion of the cistern, for example, from one of the sidewalls or cover. The first chamber must, however, always have an opening to the atmosphere through which water must not enter when the dispenser is placed in the cistern.

If the dispenser is to be suspended from a sidewall, a hanger having means to attach to an upper edge of a sidewall and apportion connectible to the dispenser may be used. Such a hanger will preferably be further adapted to permit the adjustment of the dispenser vertically in the cistern and hence the extent to which it will be immersed. This may be achieved through the use of an elongate portion dimensioned to co-operate with a connecting means on the dispenser in a manner such that the dispenser is adjustable therealong.

The additive may be in the form of a solid and if so, desirably it will be present in the form of a block in admixture, for example, with components to control the rate at which the additive is released into the surrounding water. Compositions for such blocks are well known in the art and require no elaboration in this specification. However, to assist in attaining the controlled release of additive, the dimensions of the block may be controlled together with its density.

In those cases where the additive is in the form of granules or the like, their size and density should be sufficient to prevent them from being carried over into the second chamber.

The additive may also be in the form of a gel, paste, emulsion, viscous dispersion, viscous solution, or dispersed or dissolved in water-immiscible liquid(s), provided that the additive in the form selected is capable of being dissolved or dispersed into the cistern water at an appropriate rate.

The additive itself may be a variety of substances present singularly or in combination. These include dyestuffs, fragrances, disinfectants, deodorants and the like. Depending on the nature of these substances, they may be dissolved or dispersed into the water contained within the first chamber.

The dispenser may be sold with or without the additive present in the chamber. Additive may also be sold separately to allow for replacement once the additive in a dispenser is used up.

The volume of additive-containing water dispensed will be determined by a number of factors, excluding the volume occupied by the additive in solid form. These are:

(a) the extent to which the dispenser is immersed, which will in turn determine the level of water in the chambers;

(b) the volume of the second chamber below the level of water therein; and (c) the volume of the first chamber defined between the height of the second wall and the level of the water therein.

It is preferred that the chambers are formed side by side with the common wall dividing them. In this way, a common base may be used, from which the common wall upwardly extends. In such an arrangement, another upwardly extending wall may be formed around the periphery of the base.

The upper end of the second chamber may be closed by the use of a wall extending from the outer wall surrounding the first chamber to connect with the common wall.

The dimensions of the cavity formed between the walls, particularly the size of the opening in its upper end, will affect the diffusion of additive between the chambers. The rate of filling of the first chamber is not as critical as the control of the extent of diffusion. Clearly, if diffusion is excessive, then by further diffusion through the filling means and the discharge means into the cistern during quiescent periods, the effectiveness of the dispenser will be diminished.

The dimensions of the cavity will be such that the rate at which additive containing water is transferred from the first chamber to the second chamber when additive is dispensed is determined by the rate at which additive-containing water is dispensed through the discharge means. Provided that the rate of this transfer is the same or greater than the rate additive is dispensed, the dimensions of the cavity may be varied accordingly. However, as mentioned above, the dimensions of the passage should not be so large as to produce an unacceptable rate of diffusion.

The discharge means is preferably located at the lowest portion of the second chamber to maximize the efficiency of the discharge of additive and water. In an embodiment wherein the chambers have a common base, the discharge means comprises an aperture in a portion of the base of the second chamber. It will be appreciated that the dimensions of the aperture may be adjusted in accordance with the rate of discharge required.

To achieve maximum effectiveness of the dispenser of the invention, the dimensions of the aperture should be adjusted so that the rate of discharge is substantially less than the rate at which the level of water falls in the cistern during flushing. Most preferably, the rate of discharge should be such that the relatively concentrated additive-containing water held in the first chamber is dispensed into the cistern water immediately prior to emptying. In this way, a minimal amount of additive will be flushed to waste whilst a maximal concentration of additive in the toilet bowl water will be achieved.

The filling means must be located in a position that permits water to enter the second chamber when the cistern is full or during filling. Accordingly, the filling means may constitute an aperture located in an outer wall or in the base of the second chamber. If it is located in an outer wall, it will be located below the level of the water in the cistern when full.

Preferably, the filling means will also constitute the discharge means. Most preferably, such means will comprise an aperture in the base of the second chamber.

In use, the dispenser is partially immersed in the cistern water to a depth sufficient to cause water to enter the first chamber from the second chamber via the opening in the upper end of the cavity. Both of the chambers will be filled to a level somewhere above the height of the second wall, the exact level being determined by the extent of immersion.

At equilibrium, the level of water in the chambers of the dispenser and the cistern will be equal.

Once water enters the first chamber, additive will become dispersed or dissolved in the water. Some of the additive will diffuse into the water of the second chamber as the chambers are in fluid communication via the cavity. However, the concentration of additive in the water of the first chamber will be substantially greater than that of the second chamber.

When the cistern is emptied, water containing additive will be dispensed into the cistern water once the level of water in the cistern begins to fall. Discharge will continue until the level within the first chamber reaches the top of the second wall and the second chamber is empty. However, the greatest concentration of additive will be dispensed when the cistern is near empty. This will include the water from the first chamber.

BRIEF DESCRIPTION OF THE DRAWINGS

Two embodiments of the invention will now be described with reference to the accompanying figures in which.

DETAILED DESCRIPTION OF PREFERRED EMBODIMENTS

Figure 1:
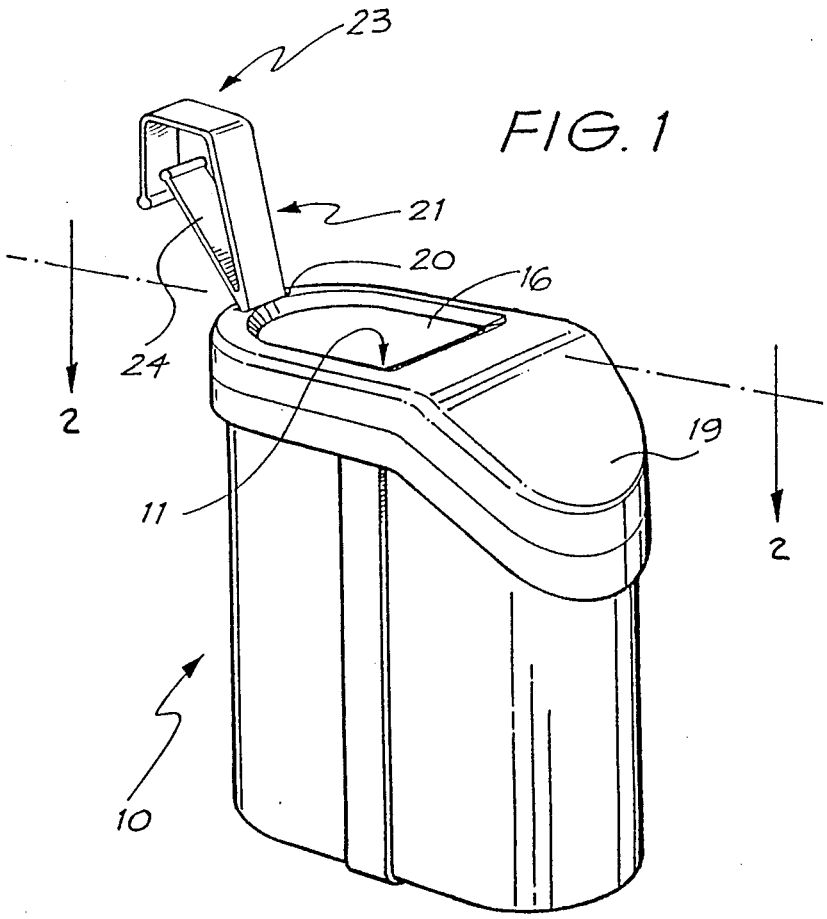
FIG. 1 is a perspective view of a dispenser of the invention.

The dispenser 10 comprises two chambers 11, 12 separated by a common wall 13. A wall 14 is spaced apart from an opening in wall 13 to form a cavity 15 having an open upper end.

In this embodiment, the volume ratio of chamber 11 to chamber 12 is 2.1:1, whilst the cross-sectional dimensions of the cavity 15 are $5 \times 5$ mm.

At an upper end of chamber 11 is an opening 16 to the atmosphere, through which a solid additive contained in the form of a block (not shown) is to be placed. In this embodiment, the block contains a dyestuff as additive.

In base 18 of chamber 12, there is a small, circular opening 17 that permits the discharge of water containing additive. The same opening 17 permits water to enter chamber 12. An opposing end 19 is closed.

In an opening 20, adjacent the open end 16 of chamber 11, there is a hanger 21 that permits the dispenser 10 to be located within a cistern. The hanger 21 has an elongated portion 22 dimensioned to fit within the opening 20. Notches, not shown, on the elongated portion allow the hanger to be positioned in the dispenser. At an upper end of the hanger 21 is a U-shaped portion 23 adapted to fit over the side of a cistern and be held there by a resiliently biassed portion 24.

Figure 4:
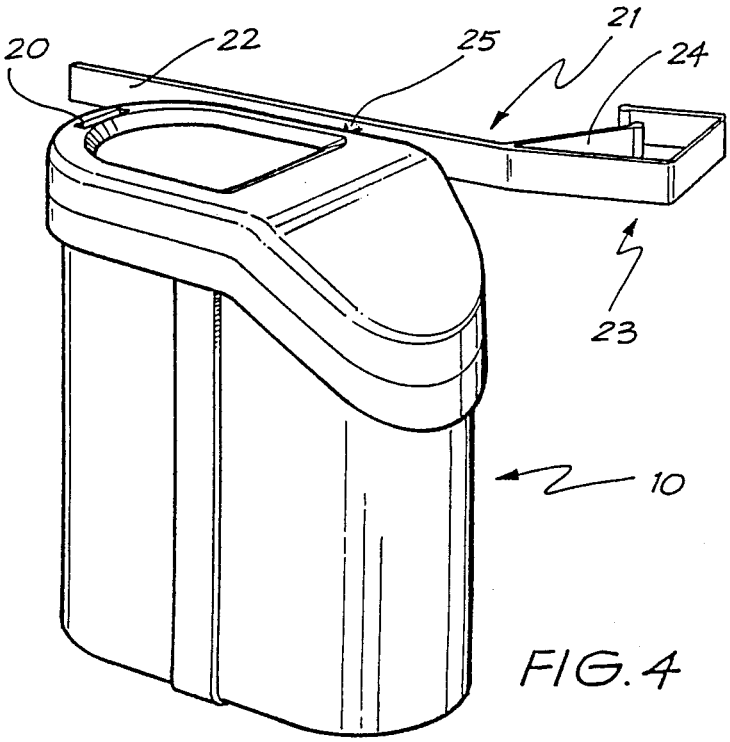
FIG. 4 is a perspective view of another embodiment of the dispenser of the invention.

All of the components of the dispenser 10, including the hanger 21, may be injection moulded using a thermoplastic material. The dispenser may be moulded with the hanger if it is, for example, aligned longitudinally as shown in FIG. 4.

In use, a block of solid additive is placed in chamber 11 prior to the immersion of the dispenser 10 in the water of a cistern. The hanger 21 is slid through opening 20, with the U-shaped portion 23 facing away from the chamber 11. The dispenser 10 is then immersed whilst the U-shaped portion 23 is placed over the upper edge of a wall of the cistern, being held there by the resilient bias of portion 24 acting on an inner surface of the wall.

By moving the dispenser 10 along the hanger 21, the position of the dispenser may be adjusted in the water until water enters chamber 11 through opening 17 and cavity 15.

The dispenser will then function as follows:

Once immersed, water will enter and fill chamber 12 through opening 17. When the water level reaches the top of wall 14, water will enter chamber 11 through cavity 15. Water will continue to enter chamber 11 until it reaches the level of the water in the cistern. The level of the water in the chambers 11, 12 will be somewhere above the top of wall 14, thereby ensuring that chambers 11, 12 will remain in fluid communication.

During immersion, additive will be dissolved or dispersed in the water in chamber 11. By virtue of the fluid communication with the water in chamber 12, some additive will diffuse into chamber 12. However, the concentration of additive will be substantially greater in chamber 11.

Naturally, the greater the contact time between the water held within chamber 11 and the additive block, the greater the resultant concentration of additive in the water.

During flushing, the water level falls in the cistern thereby causing the level of water in the dispenser to fall and additive to be dispensed. As the rate of discharge from opening 17 is substantially less than the rate of fall of water in the cistern, water containing additive from chamber 11 will be discharged when the cistern is near empty.

When the cistern is empty and discharge is completed, water will remain in chamber 11 to the height of wall 14. The volume of additive-containing water discharged will be equal to the volume of additive-containing water contained in chamber 12 together with the volume contained in chamber 11 above the top of wall 14.

Figure 2:
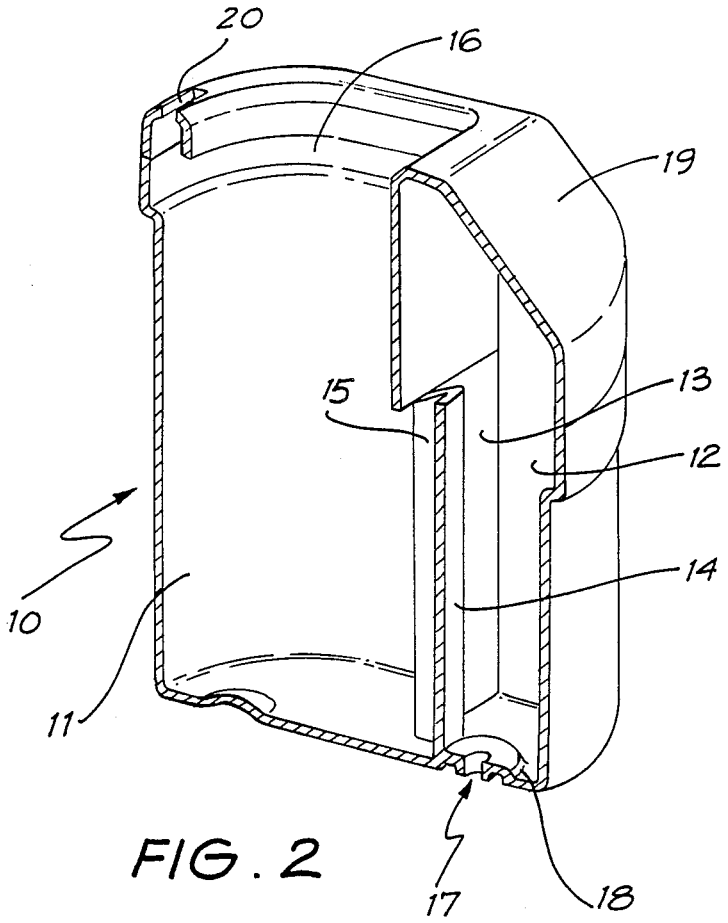
FIG. 2 is a perspective sectional view about 2—2 of FIG. 1 (with the hanger removed)
Figure 3:
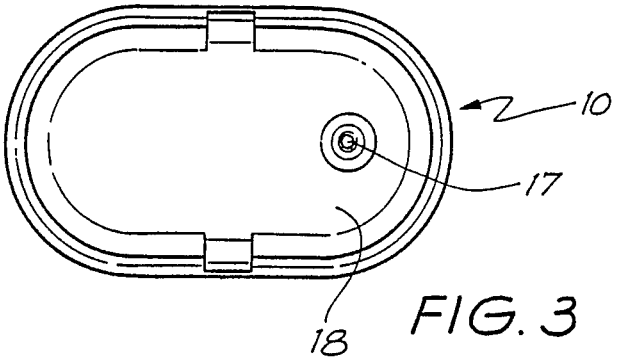
FIG. 3 is an inverted plan view of a dispenser shown in FIG. 1.

The embodiment of the dispenser 10 of the invention shown in FIG. 4 is essentially as that described with reference to FIGS. 1, 2, 3, except that hanger 21 is affixed to a side of the dispenser by a lug 25. In this configuration, the dispenser and hanger may be injection moulded together in the one mould.

In use, the lug 25 is broken by twisting hanger 21. It is then inserted into opening 20 in the manner previously described.

I claim:

1. A passive dispenser for mounting in a cistern for use in dosing a toilet bowl with an additive, said dispenser comprising:

A container having a first chamber and a second chamber formed therein in side-by-side relation with respect to a common base and separated by a common wall extending upwardly from said base, said common wall having an opening therein to permit fluid communication between said chambers, said opening being formed by a portion of said common wall being offset with respect to the remainder of said common wall, said portion extending upwardly from said base and terminating in an upper edge spaced from the remainder of said common wall to define said opening;

the first chamber being adapted to hold the additive; and the second chamber having a filling means to admit water thereinto during filling of the cistern and discharge means to discharge additive-containing water into the toilet bowl when the toilet is flushed.

2. A dispenser as in claim 1, wherein an outer wall extends upwardly around the periphery of the base and is attached to the common wall in a manner so as to define the chambers.

3. A dispenser as in claim 2, wherein the outer wall is attached to the common wall in a manner so as to close an upper end of the second chamber.

4. A dispenser as in claim 1, wherein the discharge means is located in the lowest portion of the second chamber.

5. A dispenser as in claim 4, wherein the discharge means comprises an aperture in a portion of the base underlying the second chamber.

6. A dispenser as in claim 5, wherein the discharge means comprises the filling means.

7. A dispenser as in claim 1, including a hanger means adapted to suspend the dispenser in the cistern water from an upper portion of the cistern.

8. A dispenser as in claim 7, wherein the hanger means comprises an elongate portion having at an upper end means to attach to an upper edge of a cistern sidewall, said elongate portion being dimensioned to cooperate with a connection means on the dispenser, in a manner so as to permit the dispenser to be adjustable therealong.

9. A dispenser as in claim 1 including an additive in solid form contained within the first chamber.

10. A dispenser as in claim 9, wherein the additive is in the form of a block.

* * * * *